US008038588B2

(12) United States Patent
Hobson et al.

(10) Patent No.: US 8,038,588 B2
(45) Date of Patent: Oct. 18, 2011

(54) COMBINED SHOULDER SHRUG AND NECK EXERCISE MACHINE

(75) Inventors: Tyler James Hobson, Montgomery, TX (US); Kenneth Edward Staten, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 0 days.

(21) Appl. No.: 12/727,429

(22) Filed: Mar. 19, 2010

(65) Prior Publication Data

US 2010/0240504 A1 Sep. 23, 2010

Related U.S. Application Data

(60) Provisional application No. 61/161,522, filed on Mar. 19, 2009.

(51) Int. Cl.
*A63B 21/00* (2006.01)

(52) U.S. Cl. ..... 482/142; 482/100; 482/139

(58) Field of Classification Search ..... 482/142, 482/130, 100, 97, 96, 95, 104–109
See application file for complete search history.

(56) References Cited

U.S. PATENT DOCUMENTS

| | | | | |
|---|---|---|---|---|
| 4,278,249 | A | | 7/1981 | Forrest |
| 4,402,505 | A | | 9/1983 | Young |
| 4,655,450 | A | | 4/1987 | Rogers, Jr. et al. |
| 4,722,522 | A | * | 2/1988 | Lundgren ..... 482/97 |
| 4,733,859 | A | | 3/1988 | Kock et al. |
| 4,768,779 | A | | 9/1988 | Oehman, Jr. et al. |
| 4,832,333 | A | | 5/1989 | Lockett |
| 4,893,808 | A | | 1/1990 | McIntyre et al. |
| 4,954,815 | A | | 9/1990 | Delmonte |
| 4,979,737 | A | | 12/1990 | Kock |
| 4,989,859 | A | | 2/1991 | Jones |
| 5,004,230 | A | | 4/1991 | Jones |
| 5,116,359 | A | | 5/1992 | Moore |
| 5,118,098 | A | | 6/1992 | Jones |
| 5,135,445 | A | | 8/1992 | Christensen et al. |
| 5,273,504 | A | | 12/1993 | Jones |
| 5,336,138 | A | | 8/1994 | Arjawat |
| 5,997,440 | A | | 12/1999 | Hanoun |
| 6,013,013 | A | | 1/2000 | Wolf |
| RE37,132 | E | | 4/2001 | Douglas et al. |
| 6,342,033 | B1 | | 1/2002 | Walker |
| 6,443,916 | B1 | | 9/2002 | Ilan |
| 6,482,128 | B1 | | 11/2002 | Michalow |
| 6,551,214 | B1 | | 4/2003 | Taimela |
| 6,666,801 | B1 | | 12/2003 | Michalow |
| 6,764,429 | B1 | | 7/2004 | Michalow |
| 7,104,926 | B2 | | 9/2006 | Carlson |
| 7,179,237 | B2 | | 2/2007 | Elan |
| D566,799 | S | | 4/2008 | Flavell et al. |
| 7,468,019 | B2 | | 12/2008 | Zylstra |

* cited by examiner

*Primary Examiner* — Jerome W Donnelly
(74) *Attorney, Agent, or Firm* — Carlson Gaskey & Olds PC

(57) ABSTRACT

A combined shoulder shrug and neck exercise machine includes a shrug exercise system having a first shrug arm assembly and a second shrug arm assembly and a neck exercise system operable to receive a ratio of a first weight load on the first shrug arm assembly.

14 Claims, 13 Drawing Sheets

COMBINED SHOULDER SHRUG AND NECK EXERCISE MACHINE

The present disclosure claims priority to U.S. Provisional Patent Application Ser. No. 61/161,522, filed Mar. 19, 2009.

BACKGROUND

The present disclosure relates to weightlifting equipment, and more particularly to a combined shoulder shrug and neck exercise machine.

Many athletes utilize weight lifting or weight training exercises to build strength and/or bulk, to prevent injury, or to improve overall condition and appearance. Typically, weight training exercises are performed with either exercise machines or free weights.

Free weights permit the lifter to perform the exercises in a natural motion which utilize pure body leverage in performing the exercise. Oftentimes it is desirable to simulate the range of motion of free weights within the relatively controlled environment of an exercise machine.

Many exercise machines are typically focused to a specific muscle group. Focus on the specific muscle group is a key element of an exercise machine. Other exercise machines may permit a multiple of exercises for a multiple of muscle groups.

SUMMARY

A combined shoulder shrug and neck exercise machine according to an exemplary aspect of the present disclosure includes a shrug exercise system having a first shrug arm assembly and a second shrug arm assembly, the first shrug arm assembly operable to receive a first weight load and the second shrug arm assembly operable to receive a second weight load. A neck exercise system operable to receive a ratio of the first weight load on the first shrug arm.

A combined shoulder shrug and neck exercise machine according to an exemplary aspect of the present disclosure includes a first and second shrug arm assembly pivotally mounted to a frame assembly, the first and second shrug arm assembly operable to receive a respective first and second weight load. A head assembly pivotally mounted to the frame assembly, the head assembly operable to receive a ratio of the first weight load on the first shrug arm.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 1I is a expanded rear view of a head assembly of the combined shoulder shrug and neck exercise machine in a stowed position;

DETAILED DESCRIPTION

Figure 1A:
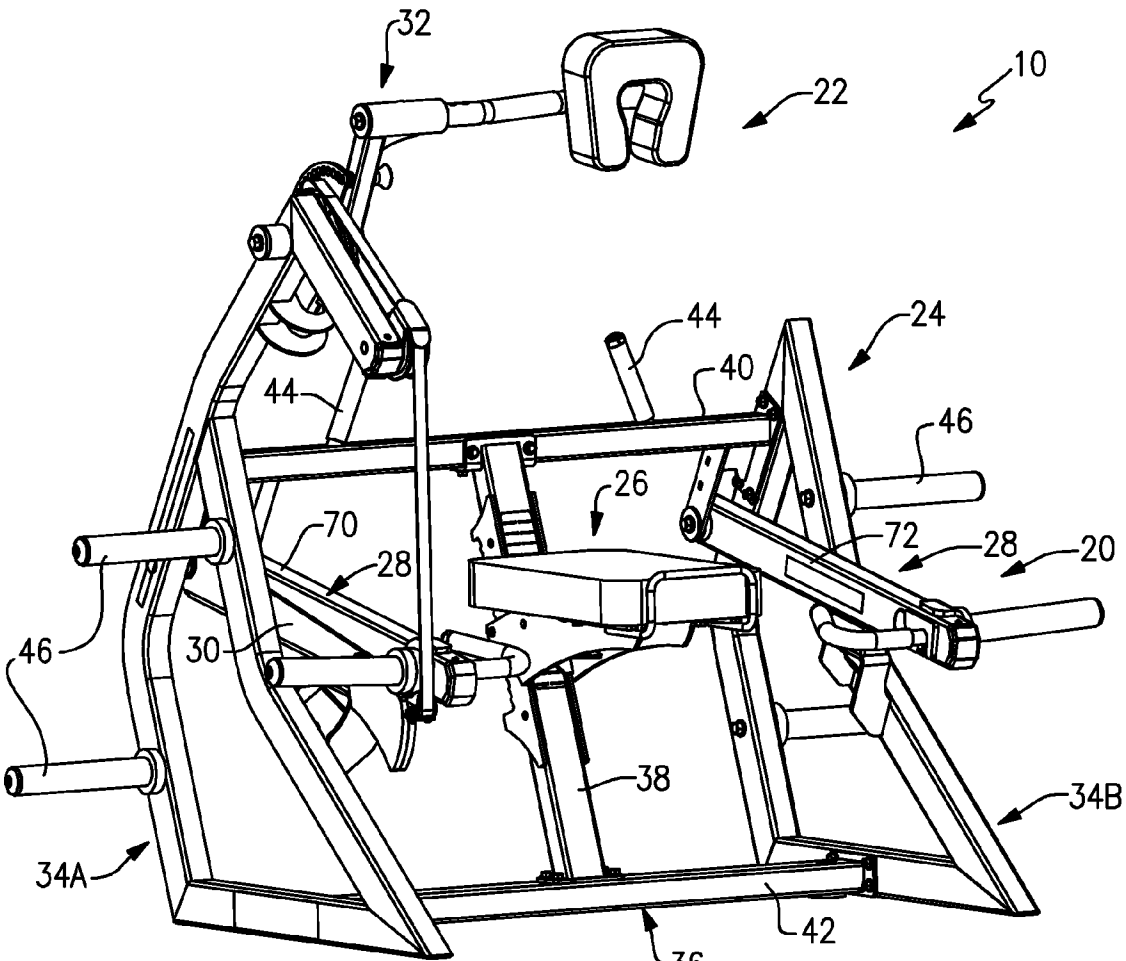
FIG. 1A is a front right perspective view of a combined shoulder shrug and neck exercise machine.

FIG. 1A illustrates perspective views of a combined shoulder shrug and neck exercise machine 10 that includes a shrug exercise system 20 and a neck exercise system 22. The machine generally includes a frame assembly 24, a seat assembly 26, a shrug arm assembly 28, a neck lift arm 30 and a head assembly 32.

The frame assembly 24 includes a right side frame 34A and a left side frame 34B fixed to a center frame 36. The center frame 36 includes a center bar 38 with cross bars 40, 42 which attach to the side frames 34A, 34B. The center bar 38 supports the seat assembly 26 while the cross support 40 includes fixed handles 44. Weight horns 46 may extend from the side frames 34A, 34B to store weight plates. Although the frame assembly 24 is manufactured of rigid square cross-section tubing in the disclosed non-limiting embodiment, it should be understood that other structures may alternatively be provided.

Figure 1B:
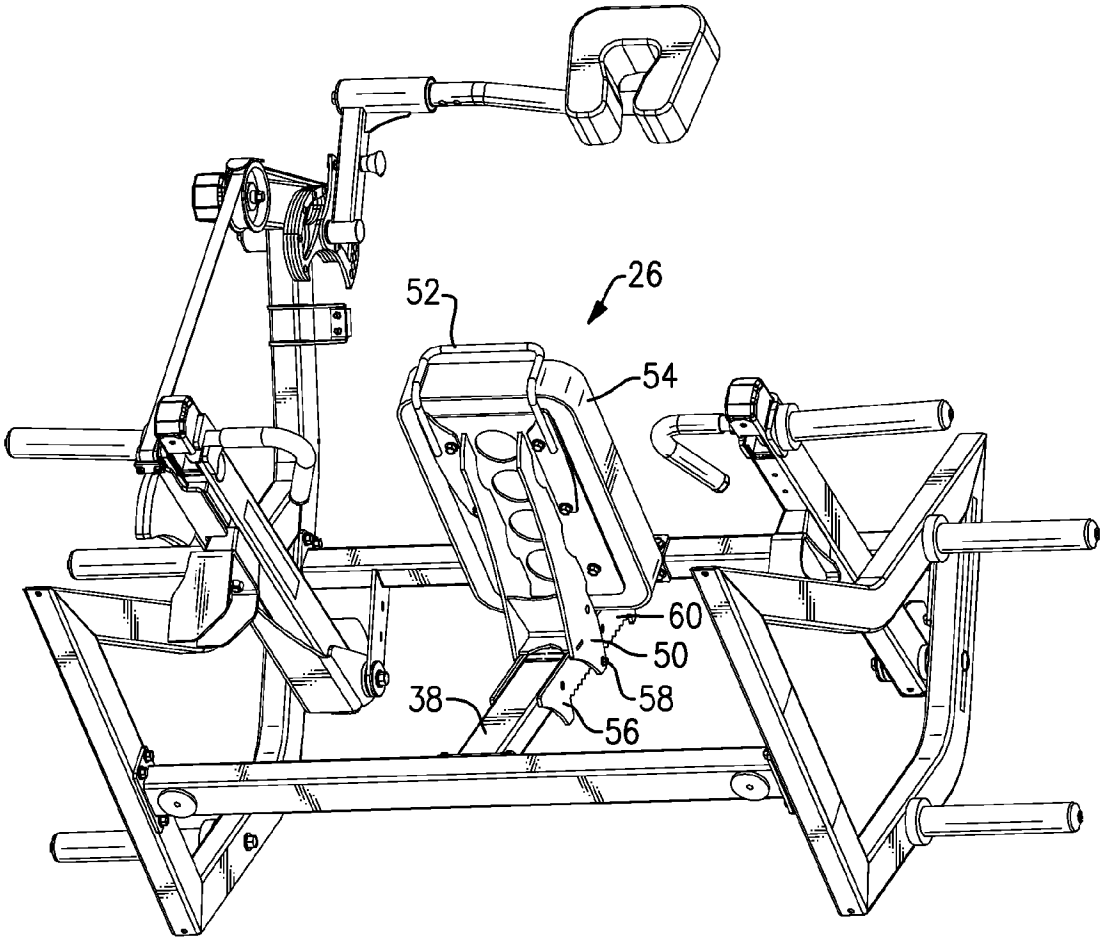
FIG. 1B is a bottom perspective view of the combined shoulder shrug and neck exercise machine.

Referring to FIG. 1B, the seat assembly 26 generally includes a seat frame 50, a seat handle 52, a seat pad 54 and seat position brackets 56. The seat pad 54 is mounted atop the seat frame 50 and the seat handle 52 extends forward therefrom opposite the center bar 38. The seat handle 52 extends from the seat frame 50 to pivot the seat frame 50 relative to the position brackets 56 to position a transverse bar 58 on the seat frame 50 into one of a multiple of slots 60 which positions the seat frame 50 at a desired vertical height. The transverse bar 58 extends around the position brackets 56 such that the seat frame 50 may be lifted to disengage the transverse bar 58 from the multiple of slots 60 so that the height position of the seat pad 54 adjusted.

Figure 1C:
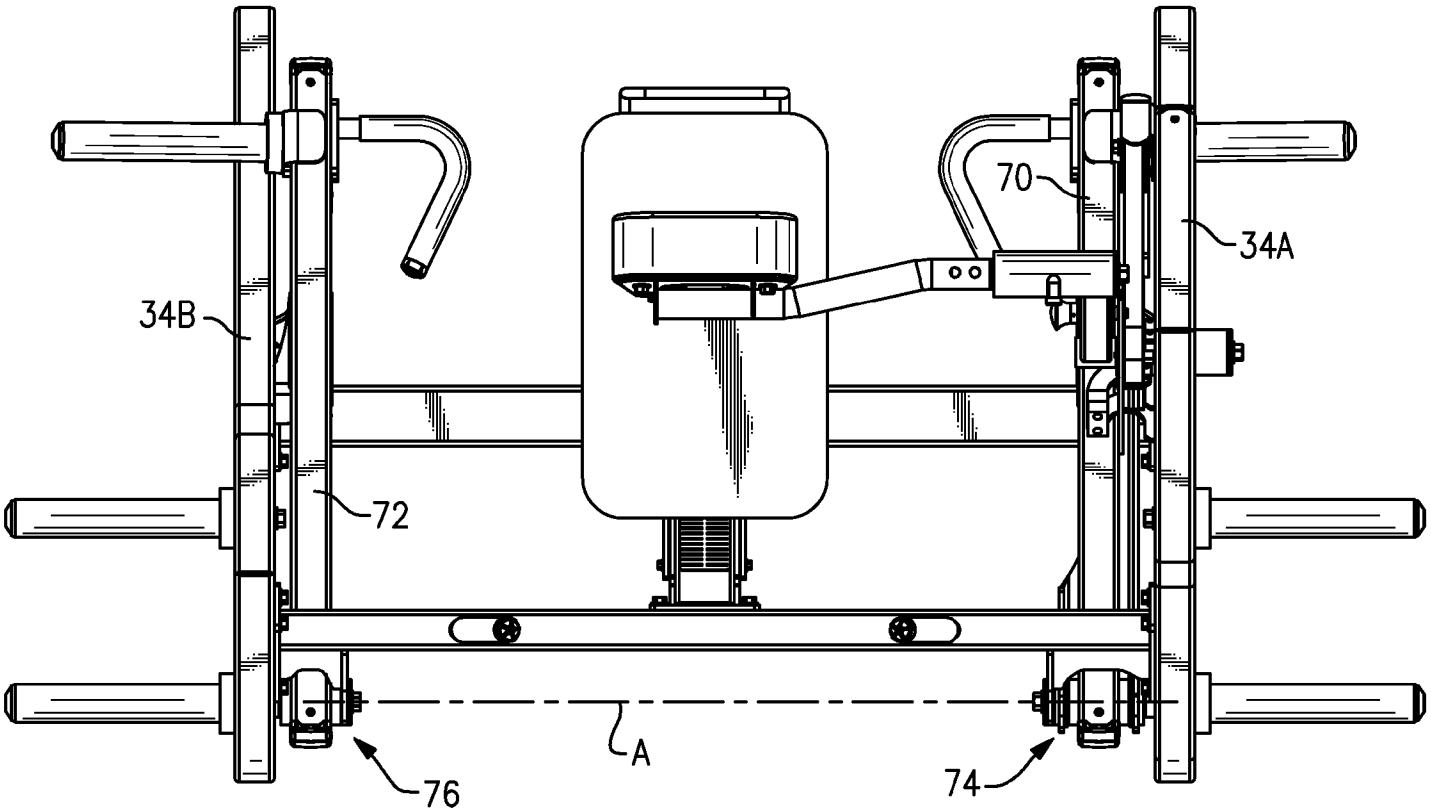
FIG. 1C is a top view of the combined shoulder shrug and neck exercise machine.

Referring to FIG. 1C, the arm assembly 28 includes an independently operable right shrug arm assembly 70 and a left shrug arm assembly 72. The right shrug arm assembly 70 and the left shrug arm assembly 72 are pivotally mounted to the relative right side frame 34A and the left side frame 34B at a respective pivot 74, 76. The right shrug arm assembly 70 and the left shrug arm assembly 72 in the disclosed non-limiting embodiment are pivotally mounted within the relative right side frame 34A and the left side frame 34B relative the seat assembly 26 for independent operation to facilitate focused exercise.

The shrug arm assemblies 70, 72 pivot about an axis A which is defined perpendicular to the shrug arm assemblies 70, 72 and the side frame 34A, 34B. The pivots 74, 76 may be defined by bearings, bushings, or other rotational support structure.

Figure 1D:
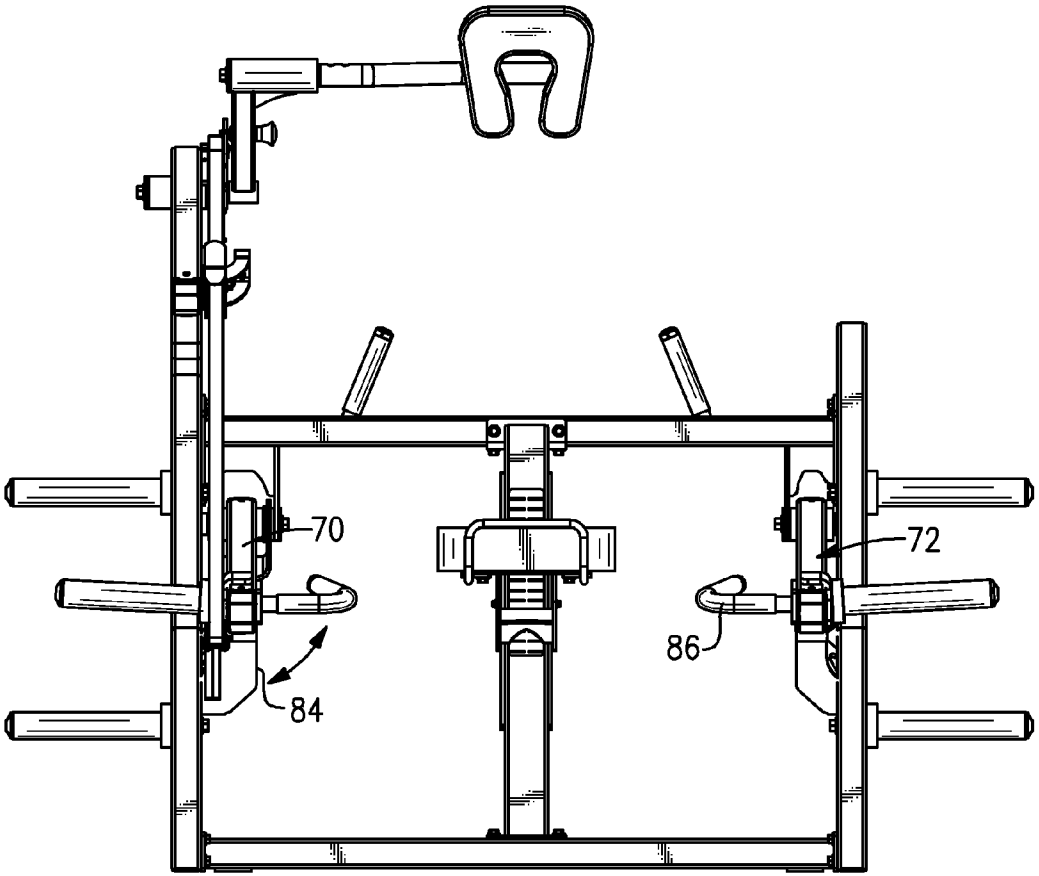
FIG. 1D is a front view of the combined shoulder shrug and neck exercise machine.

Referring to FIG. 1D, the shrug arm assemblies 70, 72 each generally include a shrug arm 78, 80, a weight horn 80, 82 to load weight plates thereon and a shrug handle 84, 86. The shrug handle 84, 86 is generally inboard of the respective weight horn 80, 82. Either one of both of the shrug handles 84, 86 may be movable between an exercise position (FIG. 2) generally perpendicular to the shrug arm 78, 80 and a stowed position generally perpendicular to the respective shrug arm 78, 80. The stowed position facilitates side exercise with the head pad assembly 30 (FIG. 3).

Figure 1E:
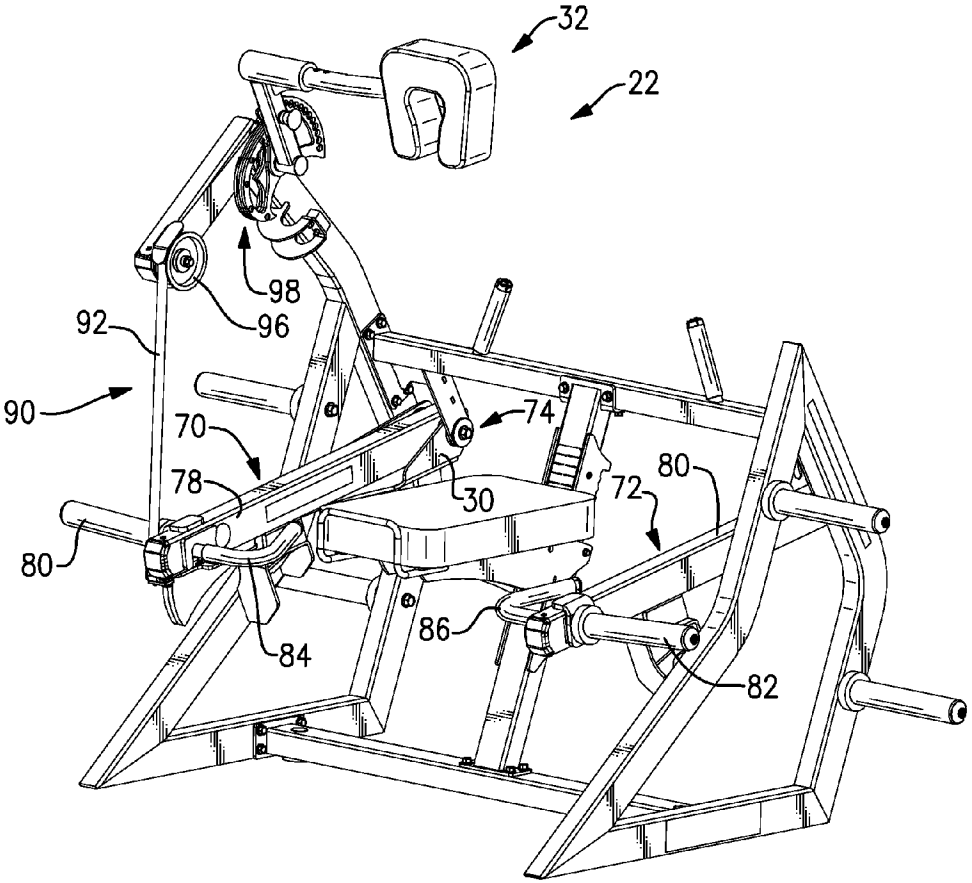
FIG. 1E is a front left perspective view of the combined shoulder shrug and neck exercise machine.
Figure 1G:
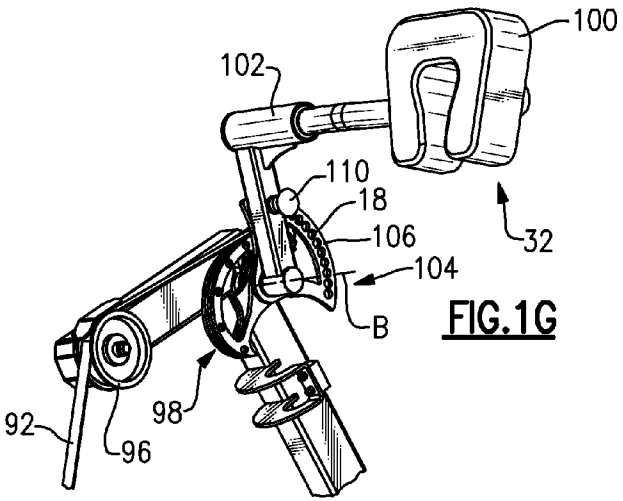
FIG. 1G is a expanded view of a head assembly of the combined shoulder shrug and neck exercise machine.
Figure 1H:
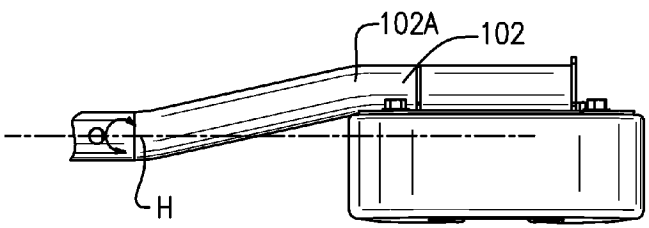
FIG. 1H is a expanded rear view of a head assembly of the combined shoulder shrug and neck exercise machine.
Figure 1F:
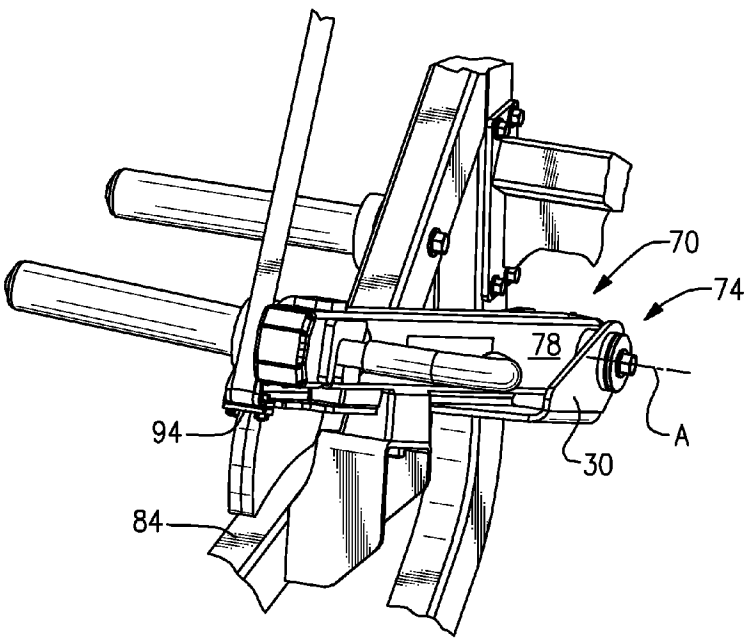
FIG. 1F is an expanded perspective view of a right shrug arm assembly.
Figure 4:
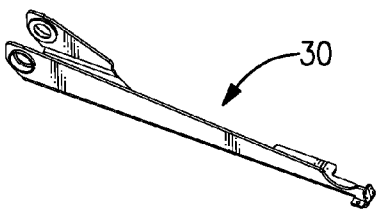
FIG. 4 is a perspective view of a neck lift arm.
Figure 11:
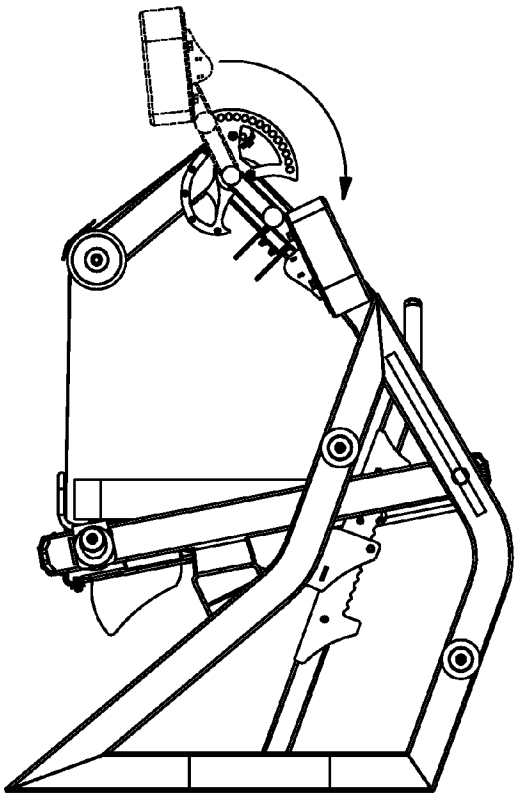

Referring to FIG. 1E, the neck system 22 generally collocates the neck lift arm 30 with right shrug arm assembly 70. That is, the neck lift arm 30 pivots about the same pivot 74 as the right shrug arm 78. The neck lift arm 30 (FIG. 4) is define by a generally U-shaped channel to at least partially receive the right shrug arm 78 (FIG. 1F).

The neck lift arm 30 is attached to the head assembly 32 through a pulley system 90. The pulley system 90 includes a belt 92 or other flexible member such as a cable. The belt 92 is attached between a fixed point 94 (FIG. 1F) on the neck lift arm 30, runs over a pulley 96 mounted to the side frame 32A and is fixed to a cam 98 on the head assembly 32 (FIG. 1G). The pulley 96 and the cam 98 rotate relative the side frame 32 in response to rotation of the head assembly 32 which is weighted by the neck lift arm 30 and the right shrug arm assembly 70 which supports a desired weight on the weight horn 80. That is, the head assembly 32 lifts the neck lift arm 30 and the right shrug arm assembly 70 through the pulley system 90.

The pulley system 90 operates to reduce the weight on the right shrug arm assembly 70 by a desired ratio. In one non-limiting embodiment, the pulley system provides a ratio of approximately 3.5:1 between the right shrug arm assembly 70 of the shrug exercise system 22 and the neck exercise system 24 such that a 45 pound weight plate on the right shrug arm assembly 70 would result in approximately 13 pounds of weight on the head assembly 32. Such a ratio has been found to be a desired ratio for the targeted athletes.

Referring to FIG. 1G, the head assembly 32 generally includes a head pad 100 and an arm 102 which is mounted to the cam 98 through a position assembly 104. The head pad 100 is rotationally mounted to the arm 102 (FIG. 1H). Notably, the arm 102 includes a bend 102A such that the head pad 100 is along an axis H defined by the arm 102. The head pad 100 is free to rotate approximately forty five degrees (45°) about the axis H defined by the arm 102. The bend 102A positions the head pad 100 to facilitate the a more comfortable and ergonomic neck exercise.

The position assembly 104 includes a position plate 106 with a multiple of apertures 108. The position plate 106 is fixed to the cam 98 for rotation therewith about a common axis of rotation B. The arm 102 is positioned in one of the multiple of apertures 108 through a lock pin 110 to thereby provide for a multiple of start positions for the arm 102 and the head pad 100 associated with each of the apertures 108. The arm 102 may additionally be placed in a stowed position (FIG. 1I) by removal of the lock pin 110 completely from the cam 98.

To summarize operations of the machine 20 in accordance with the method of operation for the present disclosure, the athlete first positions the seat assembly 26 for shrug exercises or the seat assembly 26 and the head assembly 32 for neck exercises.

Figure 2:
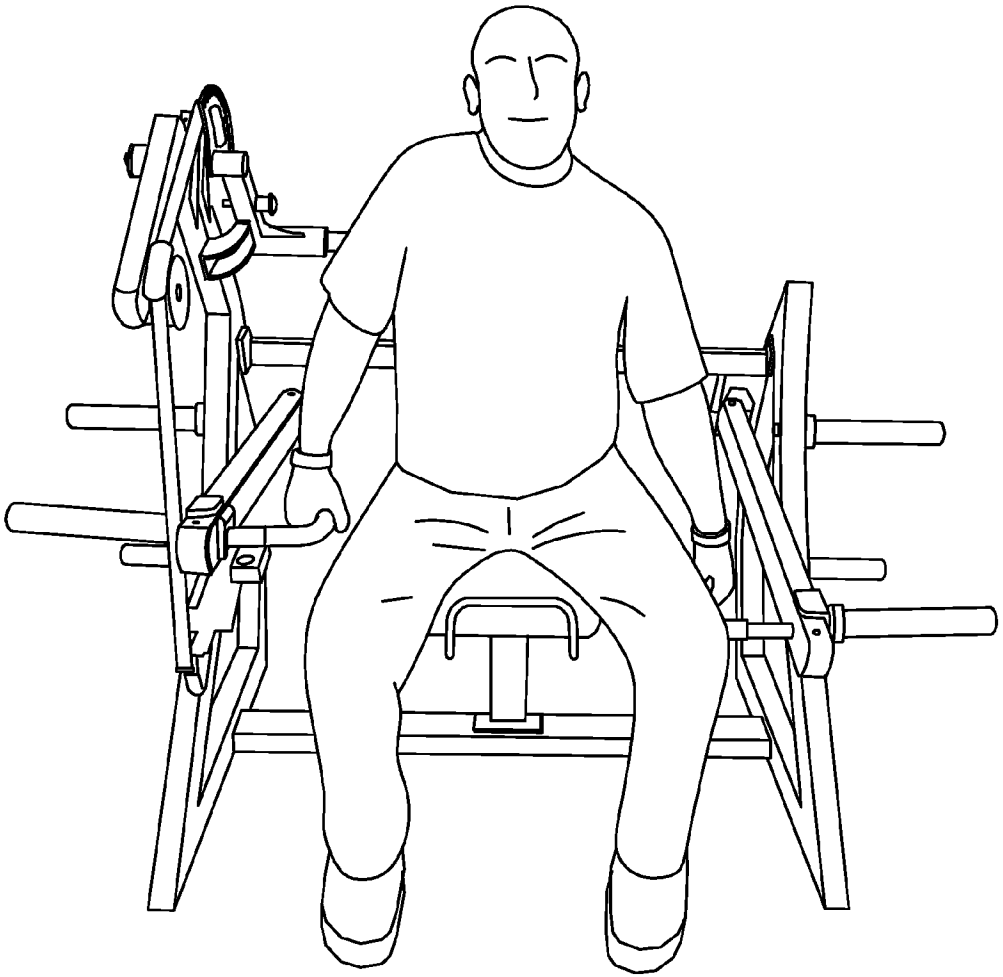
FIG. 2 is an example of the combined shoulder shrug and neck exercise machine in use to perform a shrug exercise in a shrugged position.
Figure 3:
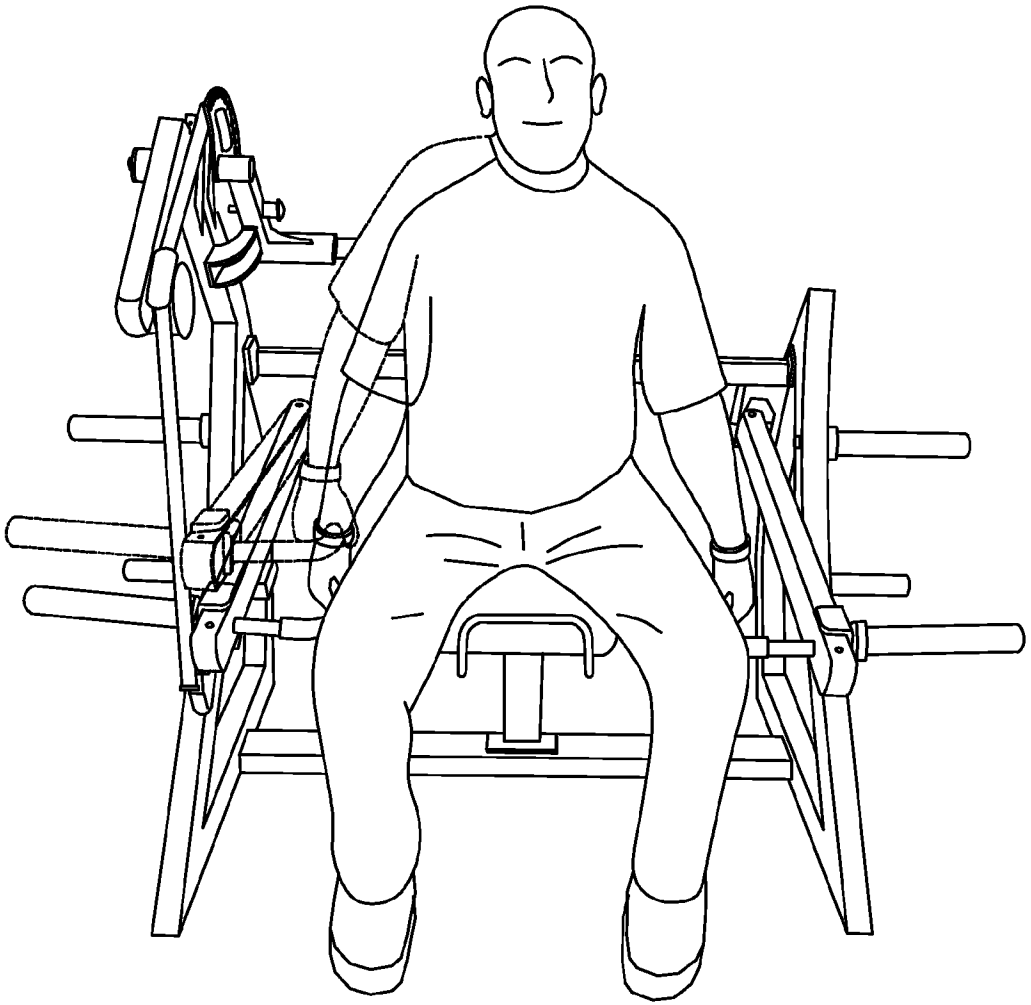
FIG. 3 is an example of the combined shoulder shrug and neck exercise machine in use to perform a shrug exercise in a rest position.
Figure 5B:
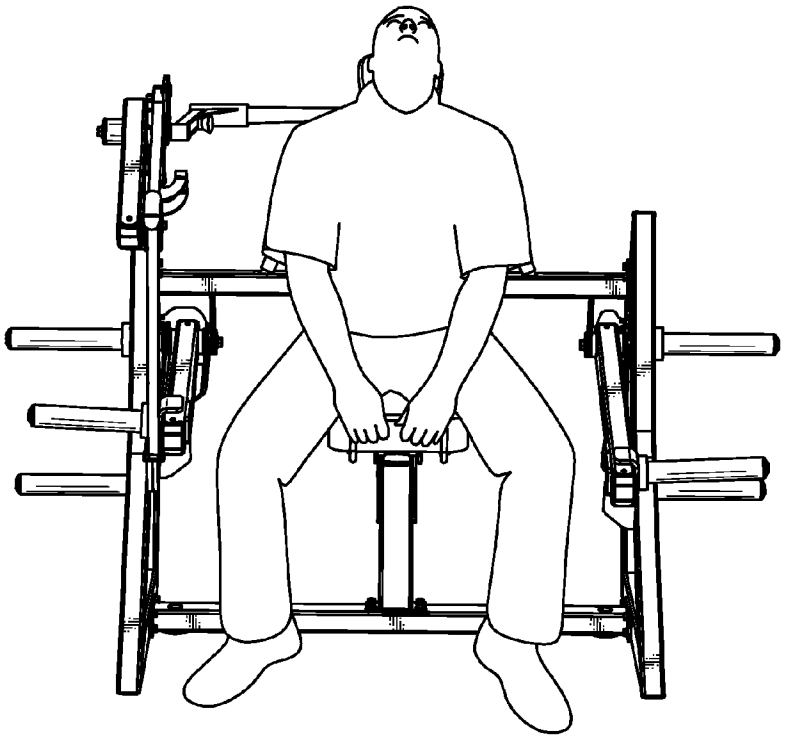
FIG. 5B is an example of the combined shoulder shrug and neck exercise machine in use to perform a rear neck exercise in an articulated position.
Figure 5A:
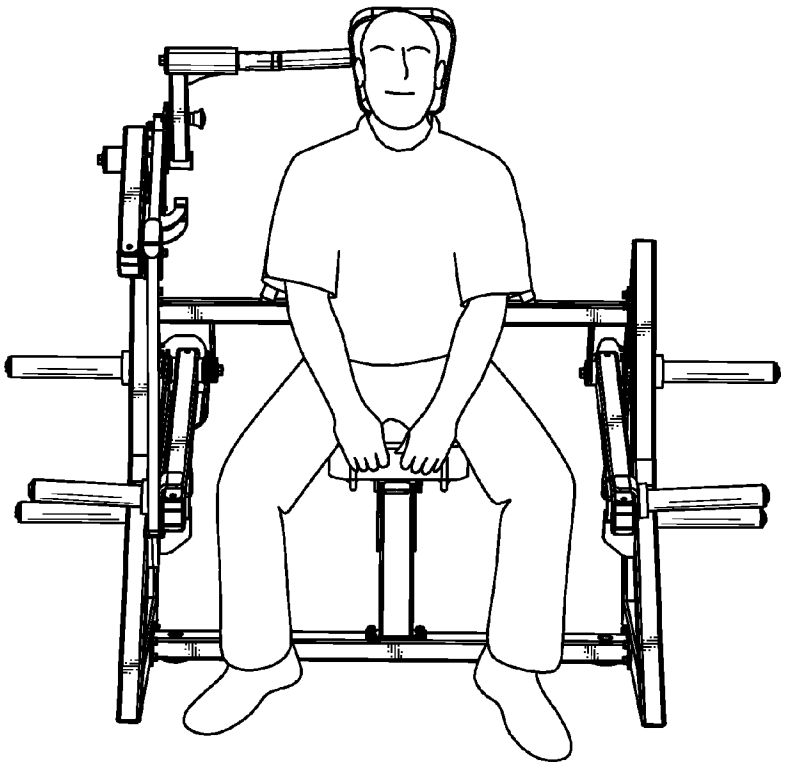
FIG. 5A is an example of the combined shoulder shrug and neck exercise machine in use to perform a rear neck exercise in a rest position.
Figure 5D:
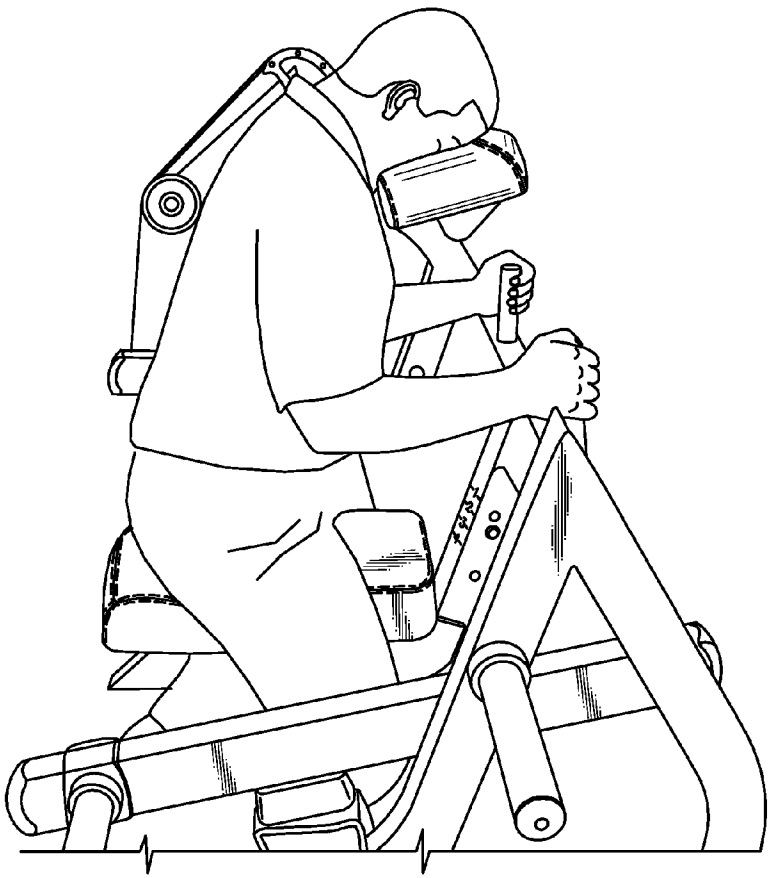
FIG. 5D is an example of the combined shoulder shrug and neck exercise machine in use to perform a front neck exercise in an articulated position.
Figure 5C:
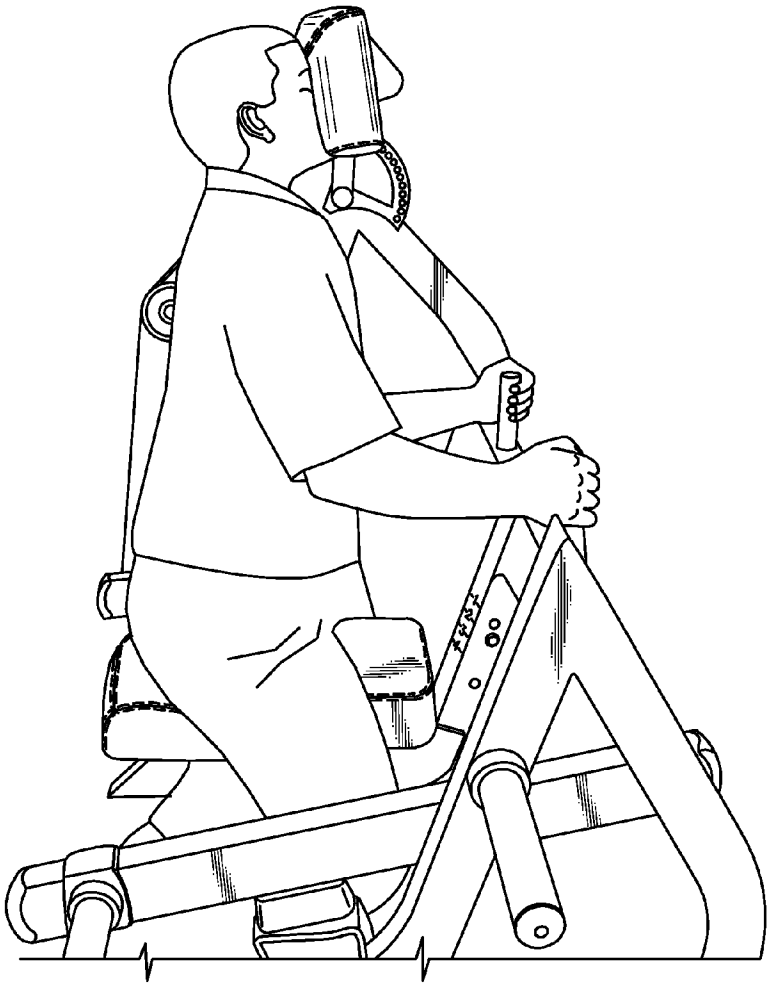
FIG. 5C is an example of the combined shoulder shrug and neck exercise machine in use to perform a front neck exercise in a rest position.

After the desired weight is placed on the weight horns 80, 82, and the seat assembly 26 positioned, the athlete need only lift the shrug handles 84, 86 to the operational position and lift the handles 84, 86 to perform the shrug exercise (FIGS. 2 and 3). Notably, the neck lift arm 30 remains in an at rest position as the right shrug arm assembly 70 is lifted during the exercise.

To perform the forward neck exercise, the athlete sits on the seat pad and faces the cross support 40 and positions the head pad 100 to the desired start position. The athlete may then grasp the fixed handles 44 and performs the forward neck exercise (FIGS. 5A-5D).

Figure 6A:
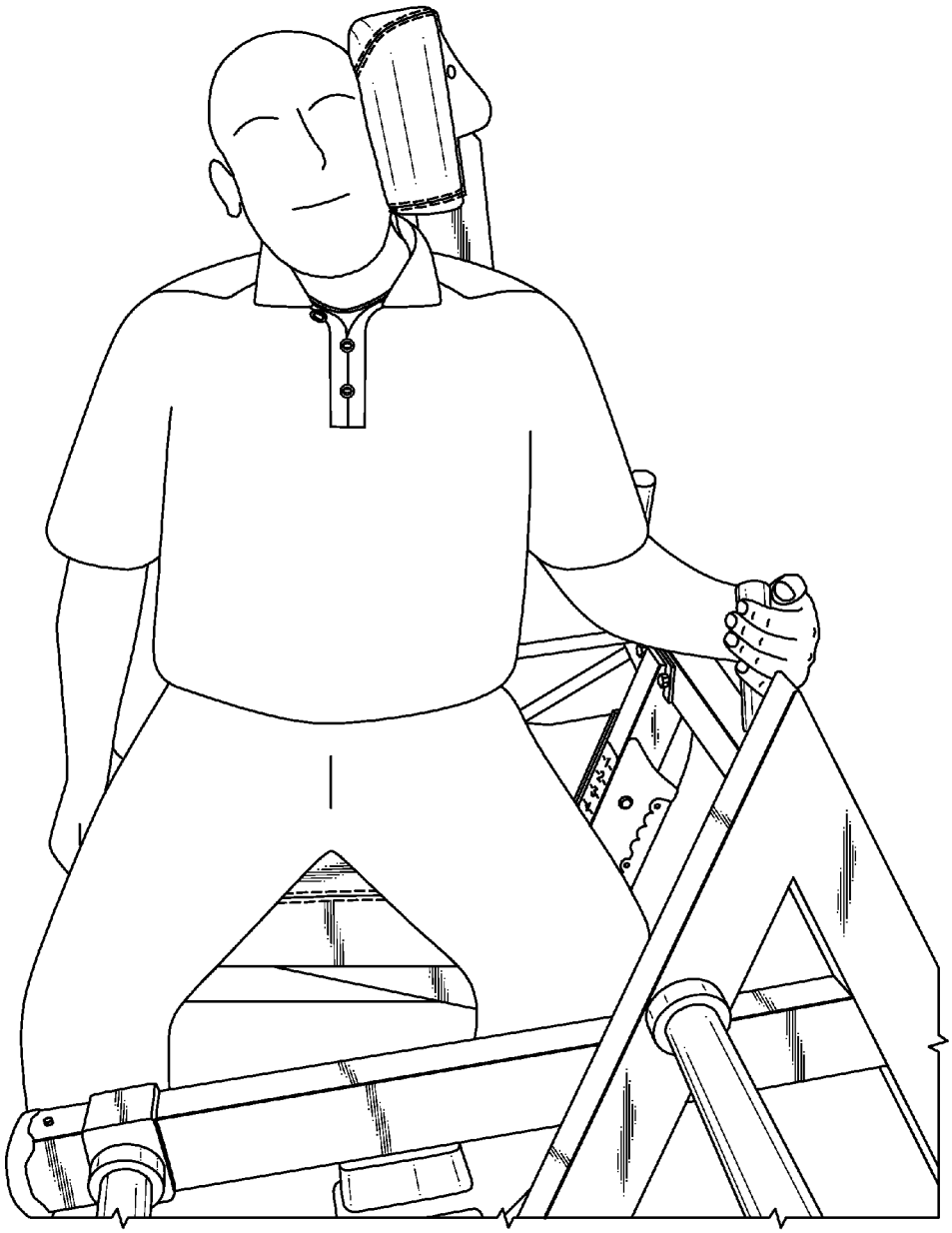
FIG. 6A is an example of the combined shoulder shrug and neck exercise machine in use to perform a side neck exercise in a rest position.
Figure 6B:
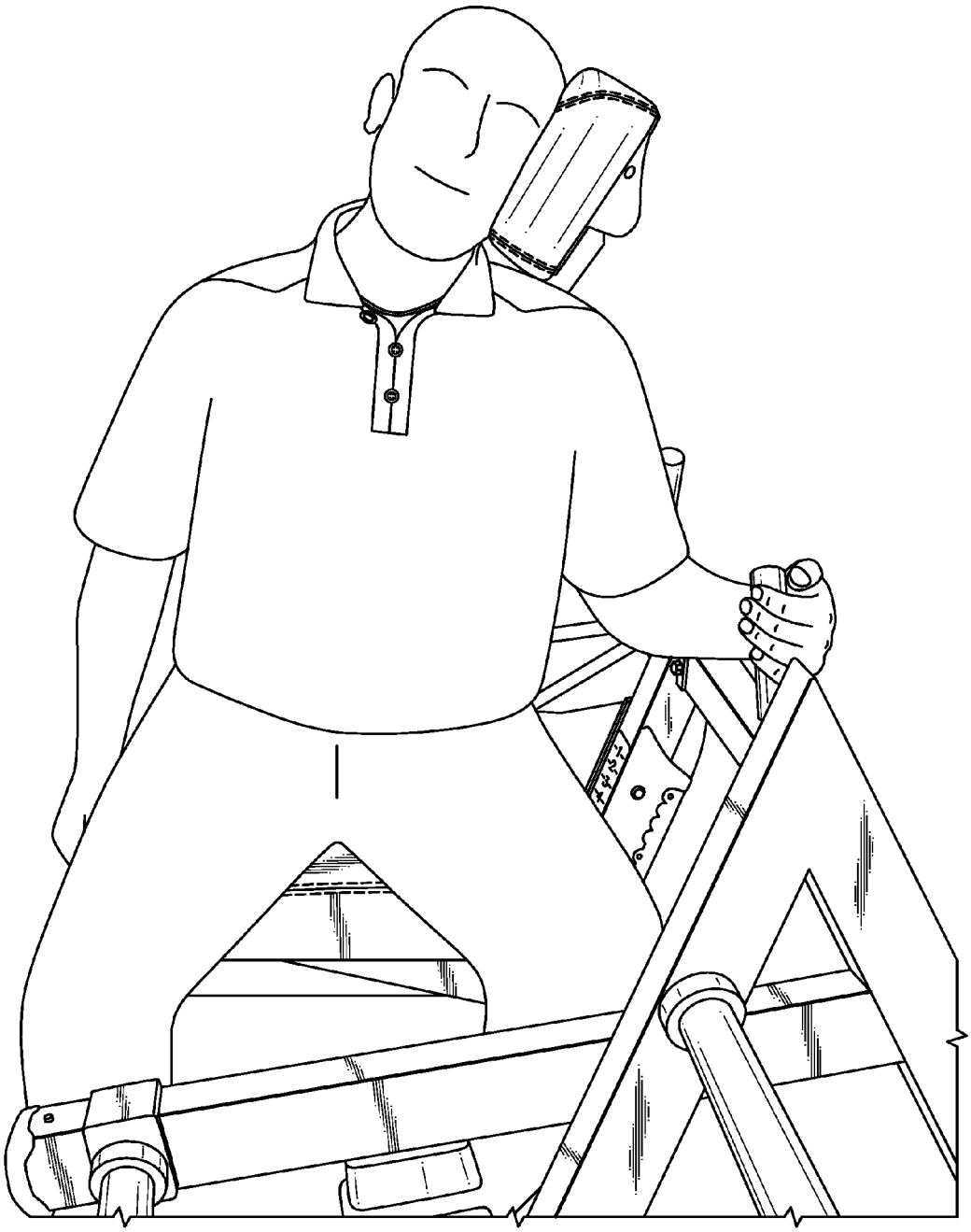
FIG. 6B is an example of the combined shoulder shrug and neck exercise machine in use to perform a side neck exercise in an articulated position.

To perform the side neck exercise, the athlete sits on the seat pad and faces either the right frame 32A or the left frame 32B and positions the head pad 100 to the desired start position. The athlete then performs the side neck exercise. The seat handle 52 also provides a hand hold for a side neck exercise (FIGS. 6A-6B). That is, the seat handle 52 allows an athlete a hold which facilitates isolation of the neck muscles to minimize usage of other torso muscle groups which are not the focus of the neck exercise system 22 and may otherwise facilitate "cheating". The shrug handles 84, 86 in the stowed position provides space for the legs of the athlete when the side neck exercise is performed.

It should be understood that relative positional terms such as "forward," "aft," "upper," "lower," "above," "below," "right", "left" and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed:

1. A combined shoulder shrug and neck exercise machine comprising:

a shrug exercise system having a first shrug arm assembly and a second shrug arm assembly, said first shrug arm assembly operable to receive a first weight load and said second shrug arm assembly operable to receive a second weight load; a neck exercise system operable to receive a ratio of said first weight load on said first shrug arm assembly, said neck exercise system includes a neck lift arm wherein said neck lift arm pivots independently of said first shrug arm about a common axis to transfer said ratio of said first weight load on said first shrug arm assembly to said neck exercise system, a neck exercise operation of said head assembly moves both said neck lift arm and said first shrug arm assembly and a shrug exercise operation of said first shrug arm assembly moves said first shrug arm assembly independently of said neck lift arm.

2. The exercise machine as recited in claim 1, further comprising a pulley system operable to transfer said ratio of said first weight load on said first shrug arm assembly to said neck exercise system, said pulley system interconnects said neck lift arm and a head assembly of said neck exercise system.

3. The exercise machine as recited in claim 1, wherein said neck lift arm is below said first shrug arm assembly.

4. The exercise machine as recited in claim 2, wherein said head assembly includes a head pad rotationally mounted to a head arm having a bend such that said head pad rotates about an axis of rotation of said head arm, said head assembly is positional relative a frame assembly which pivotally supports said first shrug arm assembly.

5. The exercise machine as recited in claim 1, wherein said first shrug arm assembly includes a shrug handle movable between a shrug exercise position and a stowed position.

6. The exercise machine as recited in claim 5, wherein shrug exercise position is generally perpendicular to said shrug arm and said stowed position is generally perpendicular to said shrug arm.

7. The exercise machine as recited in claim 1, further comprising a seat assembly generally between said first shrug arm assembly and said second shrug arm assembly.

8. The exercise machine as recited in claim 1, wherein said first shrug arm assembly includes a first weight horn operable to support at least one weight plate and said second shrug arm assembly includes a second weight horn operable to support at least one weight plate.

9. A combined shoulder shrug and neck exercise machine comprising:

a frame assembly;

a first shrug arm assembly pivotally mounted to said frame assembly, said first shrug arm assembly operable to receive a first weight load;

a second shrug arm assembly pivotally mounted to said frame assembly, said second shrug arm assembly operable to receive a second weight load;

a head assembly pivotally mounted to said frame assembly, said head assembly operable to receive a ratio of said first weight load on said first shrug arm, said head assembly includes a head pad rotationally mounted to a head arm having a bend such that said head pad rotates about an axis of rotation of said head arm.

10. The exercise machine as recited in claim 9, wherein said head arm is positional relative to said frame assembly to set a start position of said head pad.

11. The exercise machine as recited in claim 1, wherein said neck exercise system includes a neck lift arm and a head assembly, said head assembly includes a head pad rotationally mounted to a head arm having a bend such that said head pad rotates about an axis of rotation of said head arm.

12. The exercise machine as recited in claim 11, wherein said neck exercise system includes a neck lift arm and a head assembly, said head assembly includes a head pad rotationally mounted to a head arm having a bend such that said head pad rotates about an axis of rotation of said head arm.

13. The exercise machine as recited in claim 12, wherein said system is a pulley system that interconnects a neck lift arm and a head assembly of said neck exercise system, said neck lift arm adjacent to said first shrug arm assembly.

14. The exercise machine as recited in claim 12, wherein said neck lift arm and said first shrug arm assembly pivot independently about a common axis.

* * * * *